US006027189A

United States Patent [19]

Gunderson et al.

[11] Patent Number: 6,027,189

[45] Date of Patent: Feb. 22, 2000

[54] MODULAR CABINET-MOUNTED DISPENSING SYSTEM

[75] Inventors: Jeffrey E. Gunderson, Stoughton; Ralph D. Shillingburg, Madison, both of Wis.

[73] Assignee: Acry Fab, Inc., Sun Prairie, Wis.

[21] Appl. No.: 09/025,533

[22] Filed: Feb. 18, 1998

[51] Int. Cl.[7] ..... A47F 5/08

[52] U.S. Cl. ..... 312/117; 312/122; 312/242; 211/88.01; 211/184

[58] Field of Search ..... 211/88.01, 184; 108/60, 61; 312/9.53, 9.55, 114, 117, 122, 138.1, 140.1, 242, 350, 245, 246, 234.4, 234.5, 334.23, 310, 293.3, 293.1

[56] References Cited

U.S. PATENT DOCUMENTS

| | | | |
|---|---|---|---|
| 2,752,217 | 6/1956 | Simon | 312/351 X |
| 2,955,890 | 10/1960 | Domino . | |
| 3,306,689 | 2/1967 | Isaacson et al. . | |
| 3,807,572 | 4/1974 | Luvara et al. . | |
| 3,990,752 | 11/1976 | Hoffman et al. . | |
| 4,183,438 | 1/1980 | Huczek | 211/184 X |
| 4,212,506 | 7/1980 | Merl . | |
| 4,403,700 | 9/1983 | Manlove | 211/88.01 |
| 4,453,785 | 6/1984 | Smith | 312/9.48 |
| 4,503,982 | 3/1985 | Lewis | 211/184 |
| 4,560,072 | 12/1985 | Burrell | 211/88.01 X |
| 4,913,312 | 4/1990 | Boutin . | |
| 4,925,037 | 5/1990 | Holley, Jr. . | |
| 5,255,802 | 10/1993 | Krinke et al. . | |
| 5,813,735 | 9/1998 | Wu | 312/350 X |

OTHER PUBLICATIONS

"Flush Mounting Waxed Tissue Dispenser"—Acry Fab, Inc.; 1996; 430 Linnerud Dr, Sun Prairie, Wi 53590.

"Flush Mounting Napkin Dispensers"—Acry Fab, Inc.; 1992; 430 Linnerud Dr, Sun Prairie, WI 53590.

"Flush Mounting Condiment Holders"—Acry Fab, Inc.; 1988; 430 Linnrud Dr., Sun Prairie, WI 53590.

"Flush Mounting Straw Dispensers"—Acry Fab, Inc.; 1996; 430 Linnerud Dr., Sun Prairie, WI 53590.

"Flush Mounting Lid Holder"—Acry Fab, Inc.; 1988; 430 Linnerud Dr., Sun Prairie, WI 53590.

"Flush Mounting Bag Holders"—Acry Fab, Inc.; 1996; 430 Linnerud Dr., Sun Prairie, WI 53590.

*Primary Examiner*—Janet M. Wilkens
*Attorney, Agent, or Firm*—Lathrop & Clark LLP

[57] ABSTRACT

A molded plastic housing is mounted within an opening of predetermined size in the front wall of a cabinet beneath a counter top. Evenly spaced parallel grooves in the top wall of the housing receive dispensing modules constructed with peripheral pairs of upwardly protruding fins which are spaced distances which are multiples of the spacing between the parallel grooves. Each module, be it a napkin dispenser, a straw or stir stick dispenser, other box-like unit, may be inserted at any location within the housing. The volume within a single housing may thus be occupied by many different dispensing modules, or by multiple modules of the same type. Differentiated dispensing cavities may be formed by one or more dividers having a single upwardly extending fin which engages within a housing groove, and a lower base which engages the housing lower wall. A transparent face plate has two rearwardly extending ears which are flexible to extend into the housing on either side of the dispensing modules. The face plate snaps into place on the housing, and retains the modules and the contents of the dispensing cavities within the housing. Not only are the modules easily removed for cleaning, but should it become necessary to modify or rearrange the self-serve dispensing station, the face plate is easily removed without tools, and the modules may be replaced or repositioned.

21 Claims, 2 Drawing Sheets

MODULAR CABINET-MOUNTED DISPENSING SYSTEM

FIELD OF THE INVENTION

The present invention relates to cabinetry and dispensers in general, and to devices for facilitating self-service dispensing of convenience food articles and accessories in particular.

BACKGROUND OF THE INVENTION

Advances in education, production efficiencies and capital, have tended to make the services of all workers in industry and the professions more valuable and productive. At the same time, modern responsibilities of family, community, and work, together with increased commuting distances, have contributed to a fast-paced life style for many. These demands often require that meals be eaten outside the home. Many of these take-out meals are consumed as a matter of expedience, and hence the relaxed serving pace and higher cost of a conventional sit-down restaurant may not be appropriate for a consumer seeking immediate service.

Convenience food facilities, either stand-alone, or in conjunction with supermarkets, convenience stores, or filling stations, fill the consumer need for a varied assortment of foods available for a minimum investment of time. Although fast service would seem to require many service personnel, modern serving arrangements have achieved high levels of food dispensing speeds by leaving many of the final food preparation services to the consumer, i.e.: pouring drinks, selecting condiments, and discharging straws, napkins, and stir sticks.

The self-serve counter at a conventional convenience store provides an open countertop area where drink dispensers, coffee pots, and the like may be readily accessed by the customer. Individual dispensing units for napkins, straws, utensils, and condiments have typically been mounted to the front wall of a cabinet below the countertop. The mounting of each dispensing unit has required that a hole of a particular size to suit that unit be bored into the cabinet, and that the unit be affixed to the cabinet with fasteners.

Because of the competitive and fast changing nature of many convenience marketing venues, it will sometimes be necessary to reconfigure the self-serve counter to meet variations in traffic flow, menu, and clientele. Custom mounted dispensing units, each in their own sized cabinet opening, are not readily adapted to rapid change-over. Furthermore, variations in customs and service needs over a wide geographic area make it difficult for designers of convenience outlets to prepare uniform furniture and cabinet designs, as each cabinet may need to be bored differently, depending on the final choice of dispensers.

To facilitate long term planning and rapid readjustment of cabinet configurations, a system of dispensers which are readily adaptable to change without structural modification to the cabinet itself would be highly desirable.

SUMMARY OF THE INVENTION

The modular cabinet-mounted dispensing system of this invention utilizes a molded plastic housing, which may be provided in several prescribed lengths, which are adapted for mounting within openings of predetermined size in the front wall of a cabinet beneath a counter top. The plastic housing has an upper wall which is provided with an array of evenly spaced parallel grooves which open frontwardly. A vertical flange extends outwardly from the housing front opening, and serves to overlie the gap between the housing and the cabinet opening.

Dispensing modules are constructed with peripheral pairs of upwardly protruding fins which are spaced distances which are multiples of the spacing between the parallel grooves in the housing. Each module, be it a napkin dispenser, a straw or stir stick dispenser, or other box-like unit, may be inserted at any location within the housing. The volume within a single housing may thus be occupied by many different dispensing modules, or by multiple modules of the same type. Differentiated dispensing cavities may be formed by one or more dividers having a single upwardly extending fin which engages within a housing groove, and a lower base which engages the housing lower wall. A transparent face plate has two rearwardly extending ears which are flexible to extend into the housing on either side of the dispensing modules. The face plate snaps into place on the housing, and retains the modules and the contents of the dispensing cavities within the housing. Not only are the modules easily removed for cleaning, but should it become necessary to modify or rearrange the self-serve dispensing station, the face plate is easily removed without tools, and the modules may be replaced or repositioned.

It is an object of the present invention to provide a modular system of dispensers which permits various dispensing units to be placed in cabinet openings of a predetermined size.

It is another object of the present invention to provide a system of dispensers which may be easily rearranged within a self-service counter installation.

It is a further object of the present invention to provide a food service dispensing system which is easily cleaned.

Further objects, features and advantages of the invention will be apparent from the following detailed description when taken in conjunction with the accompanying drawings.

DESCRIPTION OF THE PREFERRED EMBODIMENT

Figure 1:
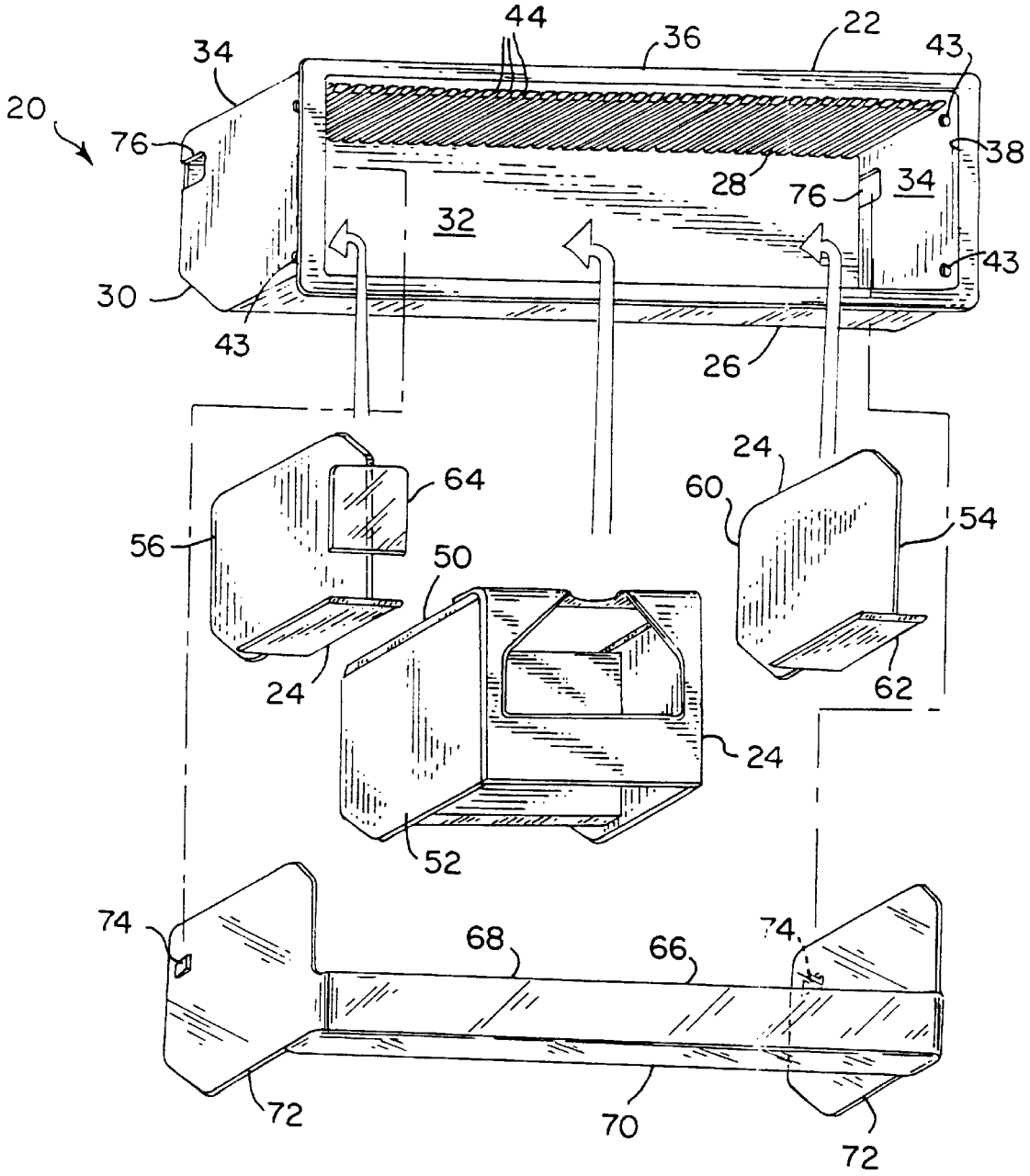
FIG. 1 is an exploded axonometric view of the modular dispensing system of this invention.
Figure 2:
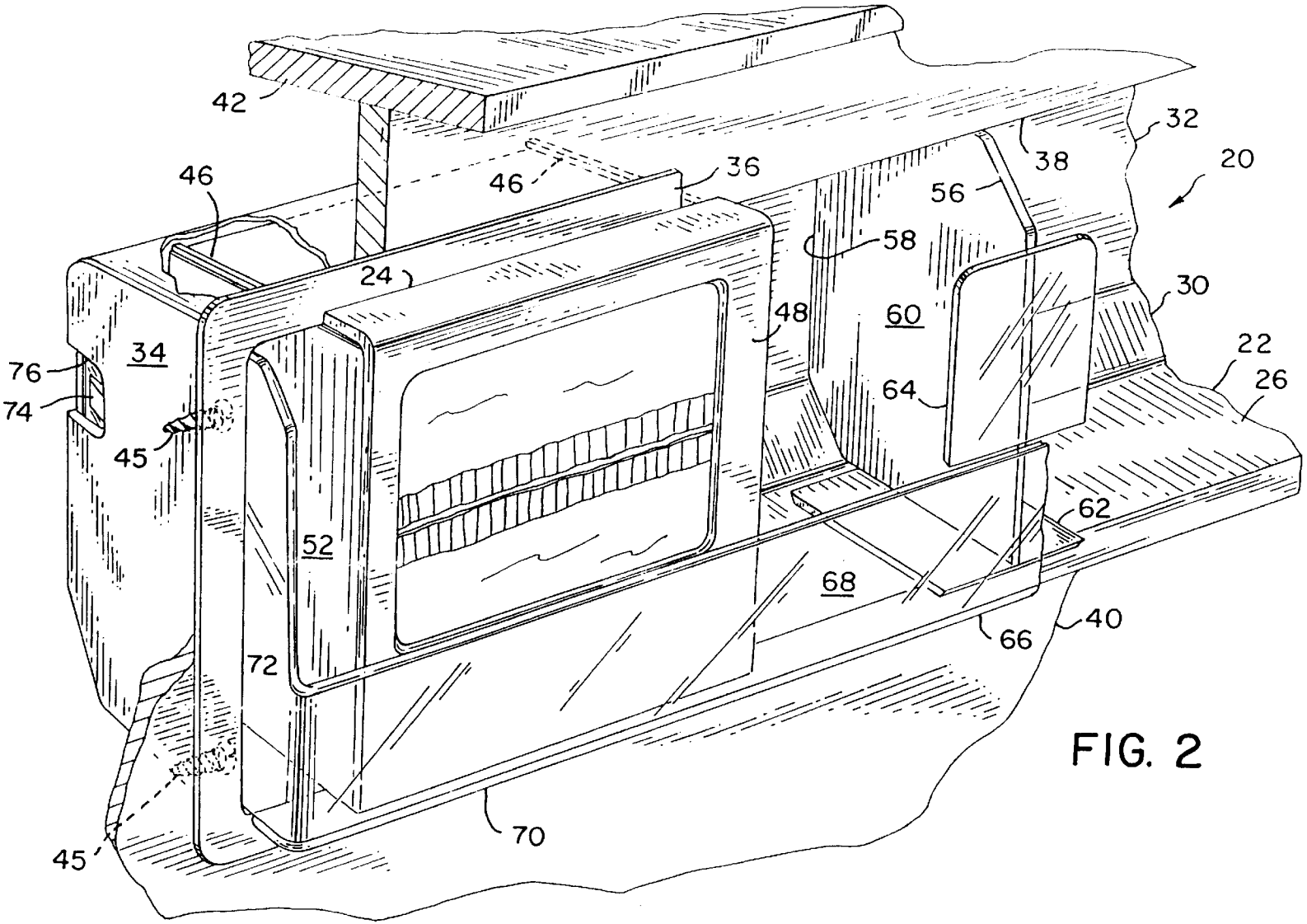
FIG. 2 is a fragmentary isometric view, partially cut away in section, of the dispensing system of FIG. 1 mounted beneath a counter.

Referring more particularly to FIGS. 1–2, wherein like numbers refer to similar parts, the cabinet mounted dispensing system 20 of this invention is shown in FIG. 1. The system 20 has a plastic housing 22 which receives one or more dispensing modules 24, which are each dimensioned to engage the housing in a friction fit. The housing 22 may be formed as a single molded plastic element, or may be assembled adhesively from a number of separate panels. The housing 22 has a bottom wall 26 which is spaced approximately parallel to and beneath a grooved top wall 28. An angled partial wall 30 extends between the bottom wall 26 and a rear wall 32. The partial wall 30 eliminates a 90-degree angle between the bottom and rear wall and hence eliminates a tight corner where food particles could accumulate. Two side walls 34 extend on either side of the top and bottom walls. A planar plastic fascia plate or flange 36 extends outwardly from the top, bottom, and side walls of the housing 22, and has an inner periphery which defines the front opening 38 of the housing 22. As shown in FIG. 2, the flange 36 extends over the front wall 40 of a counter or cabinet 42, and hides the gap between the housing 22 and the cabinet 42. Fastener openings 43 in the housing side walls 34 receive screws 45 which mount the housing to the front wall 40 of the cabinet 42.

The housing top wall 28 is formed with an array of parallel, evenly spaced grooves 44 which run the length of the top wall and which open downwardly and frontwardly. The grooves may be spaced any consistent distance, for example one half inch on centers apart. Hence, the centerline spacing of the module fins is, for example, a multiple of one half inch. Each module 24 has one or two upwardly protruding fins 46 dimensioned to fit within the grooves 44. The width of each groove should be somewhat larger than the width of a module fin. For example, the grooves may be 3/16 inches wide, and the fins may be about 1/8 inches wide. A boxlike module 24, such as a napkin dispenser 48, will have a pair of parallel fins 46, as shown in FIG. 2. The fins 46 are spaced from each other a multiple of the spacing between adjacent grooves 44, such that the module can be positioned at any desired location along the length of the housing 22. As shown in FIG. 2, there is no flange on the front of the bow 24 which extends sidewardly beyond the box side walls 52. Other boxlike modules, such as a towel dispenser 50, shown in FIG. 1, a straw or stir stick dispenser or other devices not shown, may be employed interchangeably within the housing 22. The fins 46 of the napkin dispenser 48 may be defined by the upwardly extending side panels 52 of the module. The side panels 52 will have an angled rear comer, to mate with the angled partial wall 30 at the rear of the housing 22.

Dividers 54, 56 may also be received within the housing to create a series of dispensing cavities 58 between spaced dividers, between a divider and a boxlike module, or between a divider and a side wall 34 of the housing 22. A simple divider 54 has a single upwardly extending panel 60 which serves as the fin 46 which is received within and positioned by an overhead groove 44. A beveled base plate 62 is affixed beneath the panel 60, which serves to prevent the panel from tipping, and retains it substantially parallel to the housing sidewalls and to neighboring modules. A restraining divider 56, as shown in FIG. 2, may be provided with a transparent front panel 64 which extends to either side of the upright panel 60. The front panel 64 serves to restrain larger objects within a dispensing cavity 58, for example plastic lids.

The contents of the dispensing cavities 58, and the modules 24 themselves, are retained within the housing 22 by a transparent front face plate 66. The front face plate 66 has a forward panel 68 which extends about a third of the height of the housing opening 38 and which permits visual inspection of the dispensing cavities 58 through the face plate 66. As shown in FIG. 2, the dispensing module 24 protrudes front from the housing and engages with the forward panel of the front face plate. A lower panel 70 extends rearwardly from the forward panel 68 and abuts the housing flange 36. The forward panel 68 and the lower panel 70 of the front face plate 66 are approximately at right angles to one another, and hence form a generally stiff plastic member. Two transparent plastic ears 72 extend rearwardly from the forward panel 68. The ears 72 extend approximately the full height of the housing interior, and extend approximately to the rear wall 32 of the housing 22.

The long rearward extent of the plastic ears 72 from the forward panel makes them somewhat flexible about their connection to the forward panel and the lower panel of the face plate. This flexibility is employed to releasably secure the front face plate 66 to the housing 22. A protruding wedge-shaped tab 74 extends sidewardly from each ear 72 toward the housing side wall 34 to which it is adjacent. Each tab 74 tapers to become thinner as it extends rearwardly. As a result, when the front face plate is pressed into engagement with the housing 22, the tabs 74 ride along the side walls 34 until they reach an inwardly opening recess defined by a rear aperture 76 formed in each side wall. As shown in FIG. 2, the recesses 76 define through holes which extend through the side walls 34. Once the tabs 74 are fully received within the apertures 76, the front face plate 66 is secured to the housing.

As shown in FIG. 2, the grooves in the top wall 28 terminate a sufficient distance from the side walls so that no matter what modules are installed in the housing 22, sufficient space remains for the ears 72 to be displaced inwardly by finger pressure to disengage the tabs 74 from the side wall rear apertures 76. Once disengaged, the front face plate 66 may be pulled forward and removed from the housing. When in place, the transparent front face plate 66, while permitting a clear view of the contents of the housing, prevents the escape of the condiments, utensils, lids or other dispensed items contained within the dispensing cavities. The front face plate is itself easily cleaned, and is easily removed, without tools, for cleaning of the housing and the individual modules contained therein.

When, from time to time, it is necessary to modify or rearrange the self-serve dispensing system 20, the face place is removed and the modules replaced or repositioned. Not only does the modular construction of the dispensing system make change after installation a simple matter, it also makes the advance design and specification of multiple self-service counters in different locations vastly simpler. Because the housing 22 is of known dimensions, the designer may specify counters and cabinets with openings for as many housings as space permits. The exact contents of the housing, and the specific modules to be disposed therein, need not be specified until much later, for example, after the convenience store or restaurant has been fully constructed.

It should be noted that the housing of the modular dispensing system of this invention may be made of any number of lengths, to accommodate any desired number of modules. Furthermore, many different modules, in addition to those illustrated, may be provided to serve more specific dispensing needs. The opaque portions of the housing and modules may be formed of ABS based plastics, such as CYCOLAC® , manufactured by GE Chemicals, Inc. of Parkersburg, W. Va. However, other plastic materials may also be used. The transparent portions of the modules and the front face plate may be manufactured of PETG or butyrate plastic or any suitable transparent plastic It is understood that the invention is not limited to the particular construction and arrangement of parts herein illustrated and described, but embraces such modified forms thereof as come within the scope of the following claims.

We claim:

1. A modular dispensing system comprising:

a housing for mounting within an opening in a vertical wall, the housing having a top wall which is spaced above a bottom wall, the top wall being connected to the bottom wall by two sidewardly spaced side walls, wherein portions of the top wall define a plurality of downwardly opening grooves, the grooves being spaced sidewardly from one another by a first distance, and wherein the grooves open frontwardly;

at least one dispensing module having two upwardly protruding fins, the fins being spaced sidewardly from one another a multiple of the groove spacing first distance, the at least one module being received within the housing between the housing top wall and the housing bottom wall, and being positionable therein at a plurality of locations; and a front face plate releasably connected to the housing, the front face plate having two rearwardly extending ears, the ears being spaced sidewardly from one another to extend along the housing side walls within the housing, and having portions thereon which releasably engage with the housing to retain the front face plate on the housing, the ears projecting frontwardly from the housing, to permit the ears to be engaged by a user's fingers and pressed toward one another to be displaced inwardly by finger pressure to disengage the front face plate ear portions from the housing.

2. The modular dispensing system of claim 1 wherein the front face plate ear portions which releasably engage with the housing comprise sidewardly extending tabs which extend into recesses formed on the housing side walls, and wherein the housing top wall has an un-grooved portion adjacent to each side wall, the ungrooved portions being at least as wide as the tabs, such that any module installed within the housing will be spaced from an adjacent side wall a sufficient distance to permit the ear which extends along the adjacent sidewall to be deflected inwardly to release the tab from engagement with the side wall recess.

3. The modular dispensing system of claim 1 further comprising a rear wall which extends downwardly from the top wall and which extends adjacent to the two side walls, and wherein through holes are defined in the side walls adjacent the rear wall, said through holes serving to receive the engageable portions of the front face plate ears.

4. The modular dispensing system of claim 1 further comprising a flange which extends outwardly from the top wall, the side walls, and the bottom wall to overlie the vertical wall in which the housing is mounted, wherein the flange does not obstruct entry of the module fins into the top wall grooves.

5. A modular dispensing system comprising:

a housing for mounting within an opening in a vertical wall, the housing having a top wall which is spaced above a bottom wall, the top wall being connected to the bottom wall by two sidewardly spaced side walls, wherein portions of the top wall define a plurality of downwardly opening grooves, the grooves being spaced sidewardly from one another by a first distance, and wherein the grooves open frontwardly;

at least one dispensing module having two upwardly protruding fins, the fins being spaced sidewardly from one another a multiple of the groove spacing first distance, the at least one module being received within the housing between the housing top wall and the housing bottom wall, and being positionable therein at a plurality of locations;

a front face plate releasably connected to the housing, the front face plate having two rearwardly extending ears, the ears being spaced sidewardly from one another to extend along the housing side walls within the housing, and having portions thereon which releasably engage with the housing to retain the front face plate on the housing;

a rear wall which extends downwardly from the top wall; and an angled wall which extends between the rear wall and the bottom wall.

6. A modular dispensing system comprising:

a housing for mounting within an opening in a vertical wall, the housing having a top wall which is spaced above a bottom wall, the top wall being connected to the bottom wall by two sidewardly spaced side walls, wherein portions of the top wall define a plurality of downwardly opening grooves, the grooves being spaced sidewardly from one another by a first distance, and wherein the grooves open frontwardly, at least one dispensing module having two upwardly protruding fins, the fins being spaced sidewardly from one another a multiple of the groove spacing first distance, the at least one module being received within the housing between the housing top wall and the housing bottom wall, and being positionable therein at a plurality of locations; and a front face plate releasably connected to the housing, the front face plate having two rearwardly extending ears, the ears being spaced sidewardly from one another to extend along the housing side walls within the housing, and having portions thereon which releasably engage with the housing to retain the front face plate on the housing wherein the front face plate has a forward panel and a lower panel which extends toward the housing from the forward panel.

7. A modular dispensing system comprising:

a housing for mounting within an opening in a vertical wall, the housing having a top wall which is spaced above a bottom wall, the top wall being connected to the bottom wall by two sidewardly spaced side walls, wherein portions of the top wall define a plurality of downwardly opening grooves, the grooves being spaced sidewardly from one another by a first distance, and wherein the grooves open frontwardly;

at least one dispensing module having two upwardly protruding fins, the fins being spaced sidewardly from one another a multiple of the groove spacing first distance, the at least one module being received within the housing between the housing top wall and the housing bottom wall, and being positionable therein at a plurality of locations, and a front face plate releasably connected to the housing, the front face plate having two rearwardly extending ears, the ears being spaced sidewardly from one another to extend along the housing side walls within the housing, and having portions thereon which releasably engage with the housing to retain the front face plate on the housing, wherein the dispensing module protrudes frontwardly from the housing and engages with a forward panel of the front face plate.

8. A modular dispensing system comprising:

a housing for mounting within an opening in a vertical wall, the housing having a top wall which is spaced above a bottom wall, the top wall being connected to the bottom wall by two sidewardly spaced side walls, wherein portions of the top wall define a plurality of downwardly opening grooves, the grooves being spaced sidewardly from one another by a first distance and wherein the grooves open frontwardly;

a front face plate releasably connected to the housing, the front face plate having two rearwardly extending ears, the ears being spaced sidewardly from one another to extend along the housing side walls within the housing, and having portions thereon which releasably engage with the housing to retain the front face plate on the housing, and further comprising a dispensing module which comprises:

a single upwardly extending panel which defines a fin which engages within one of the downwardly opening grooves on the top wall; and a base plate which extends sidewardly from the upwardly extending panel, the base plate being engaged against the housing bottom wall and extending frontwardly from the housing;

a module front panel which extends to either side of the upwardly extending panel, the front panel positioned above the level of the front face plate where the base plate extends adjacent the front face plate.

9. The modular dispensing system of claim 8 wherein the dispensing module front panel is transparent.

10. A housing for mounting within an opening in the vertical wall of a self-service food service cabinet, the housing comprising:

a top wall having a plurality of evenly spaced downwardly and frontwardly opening grooves, the grooves being spaced sidewardly from one another by a first distance, the grooves being positioned to receive upwardly protruding fins on a plurality of dispensing modules for adjustable positioning of the modules within the housing;

a bottom wall spaced beneath the top wall;

two side walls which extend between the top wall and the bottom wall, the side walls being spaced sidewardly from one another to define a housing interior volume between the side walls and the top and bottom wall; and portions of each side wall define recesses which open into the housing interior volume, the recesses being positioned toward the rear of the side walls to receive protruding tabs on sidewardly spaced ears of a front face plate to releasably connect the front face plate to the housing;

a rear wall which extends downwardly from the top wall; and an angled wall which extends between the rear wall and the bottom wall.

11. A modular dispensing system comprising:

a housing for mounting within an opening in an upwardly extending wall, the housing having a top wall which is spaced above a bottom wall, the top wall being connected to the bottom wall by two sidewardly spaced side walls, each side wall having at least one recess which opens into the interior of the housing, and wherein portions of the top wall define a plurality of downwardly opening grooves, the grooves being spaced sidewardly from one another;

at least one dispensing module having at least one upwardly protruding fin which engages within one of the housing top wall grooves, the at least one module being received within the housing between the housing top wall and the housing bottom wall, and being positionable therein at a plurality of locations; and a plastic front face plate releasably connected to the housing, the front face plate having a forward panel, and two ears which extend rearwardly from the forward panel, the ears being spaced sidewardly from one another to extend along the housing side walls within the housing, wherein a tab is formed on each ear of the front face plate, each tab extending sidewardly into the recess on one of the two housing side walls, and wherein the ears are deflectable about their connection to the forward panel to release the tabs from the side wall recesses for removal of the front face plate from the housing, the ears projecting frontwardly from the housing, to permit the ears to be engaged by a user's fingers and pressed toward one another to be displaced inwardly by finger pressure to disengage the tabs from the side wall recesses.

12. The modular dispensing system of claim 11 further comprising an un-grooved portion of the housing top wall adjacent to each side wall, the ungrooved portions being at least as wide as the tabs, such that any module installed within the housing will be spaced from an adjacent side wall a sufficient distance to permit the ear which extends along the adjacent sidewall to be deflected inwardly to release the tab from engagement with the side wall recess.

13. The modular dispensing system of claim 12 wherein the dispensing module has two upwardly extending fins which engage within two sidewardly spaced grooves of the housing top wall.

14. The modular dispensing system of claim 11 further comprising a rear wall which extends downwardly from the top wall and which extends adjacent to the two side walls, and wherein the recesses comprise through holes in the side walls which are positioned adjacent the rear wall.

15. The modular dispensing system of claim 11 further comprising a flange which extends outwardly from the top wall, the side walls, and the bottom wall to overlie the wall in which the housing is mounted.

16. The modular dispensing system of claim 11 wherein the dispensing module comprises a single upwardly extending panel which defines the fin, and wherein a base plate extends sidewardly from the module panel, the base plate being engaged against the housing bottom wall.

17. The modular dispensing system of claim 16 further comprising a transparent front panel which is fixed to the module upwardly extending panel to extend perpendicular thereto, the front panel being positioned above the front face plate forward panel.

18. A modular dispensing system comprising:

a housing for mounting within an opening in an upwardly extending wall, the housing having a top wall which is spaced above a bottom wall, the top wall being connected to the bottom wall by two sidewardly spaced side walls, each side wall having at least one recess which opens into the interior of the housing, and wherein portions of the top wall define a plurality of downwardly opening grooves, the grooves being spaced sidewardly from one another;

at least one dispensing module having at least one upwardly protruding fin which engages within one of the housing top wall grooves, the at least one module being received within the housing between the housing top wall and the housing bottom wall, and being positionable therein at a plurality of locations; and a plastic front face plate releasably connected to the housing, the front face plate having a forward panel, and two ears which extend rearwardly from the forward panel, the ears being spaced sidewardly from one another to extend along the housing side walls within the housing, wherein a tab is formed on each ear of the front face plate each tab extending sidewardly into the recess on one of the two housing side walls, and wherein the ears are deflectable about their connection to the forward panel to release the tabs from the side wall recesses for removal of the front face plate from the housing;

a rear wall which extends downwardly from the top wall; and an angled wall which extends between the rear wall and the bottom wall.

19. A modular dispensing system comprising:

a housing for mounting within an opening in an upwardly extending wall, the housing having a top wall which is spaced above a bottom wall, the top wall being connected to the bottom wall by two sidewardly spaced side walls, each side wall having at least one recess which opens into the interior of the housing, and wherein portions of the top wall define a plurality of downwardly opening grooves, the grooves being spaced sidewardly from one another;

at least one dispensing module having at least one upwardly protruding fin which engages within one of the housing top wall grooves, the at least one module being received within the housing between the housing top wall and the housing bottom wall, and being positionable therein at a plurality of locations; and a plastic front face plate releasably connected to the housing, the front face plate having a forward panel, and two ears which extend rearwardly from the forward panel, the ears being spaced sidewardly from one another to extend along the housing side walls within the housing, wherein a tab is formed on each ear of the front face plate each tab extending sidewardly into the recess on one of the two housing side walls, and wherein the ears are deflectable about their connection to the forward panel to release the tabs from the side wall recesses for removal of the front face plate from the housing, wherein the front face plate has a lower panel which extends toward the housing from the forward panel.

20. A modular dispensing system comprising:

a housing for mounting within an opening in an upwardly extending wall the housing having a top wall which is spaced above a bottom wall, the top wall being connected to the bottom wall by two sidewardly spaced side walls, each side wall having at least one recess which opens into the interior of the housing, and wherein portions of the top wall define a plurality of downwardly opening grooves, the grooves being spaced sidewardly from one another;

at least one dispensing module having at least one upwardly protruding fin which engages within one of the housing top wall grooves, the at least one module being received within the housing between the housing top wall and the housing bottom wall, and being positionable therein at a plurality of locations; and a plastic front face plate releasably connected to the housing, the front face plate having a forward panel, and two ears which extend rearwardly from the forward panel, the ears being spaced sidewardly from one another to extend along the housing side walls within the housing, wherein a tab is formed on each ear of the front face plate each tab extending sidewardly into the recess on one of the two housing side walls, and wherein the ears are deflectable about their connection to the forward panel to release the tabs from the side wall recesses for removal of the front face plate from the housing, wherein the dispensing module protrudes frontwardly from the housing and engages with the forward panel of the front face plate.

21. A modular dispensing system comprising:

a housing for mounting within an opening in a vertical wall, the housing having a top wall which is spaced above a bottom wall, the top wall being connected to the bottom wall by two sidewardly spaced side walls, wherein portions of the top wall define a plurality of downwardly opening grooves, the grooves being spaced sidewardly from one another by a first distance, and wherein the grooves open frontwardly;

a dispensing module engaged within the housing, the dispensing module comprising a box with portions which extend upwardly to engage within the housing top wall grooves, the module being received within the housing between the housing top wall and the housing bottom wall and being releasably engaged therein for repositioning within the housing; and a front face plate releasably connected to the housing, the front face plate having portions which extend in front of the dispensing module within the housing, wherein the front face plate is has rearwardly extending ears which are resiliently engaged with the housing for convenient removal therefrom, the ears projecting frontwardly from the housing, to permit the ears to be engaged by a user's fingers and pressed toward one another to be displaced inwardly by finger pressure to disengage the ears from the housing.

* * * * *